US006165182A

United States Patent [19]

Caric et al.

[11] Patent Number: 6,165,182

[45] **Date of Patent: *Dec. 26, 2000**

[54] DEPILATION APPARATUS WITH VIBRATION MEMBER

[75] Inventors: Drazen S. Caric, Klagenfurt; Hermann Jordan, Maria Saal; Wolfgang J. Obermann, Bruck/Mur, all of Austria

[73] Assignee: U.S. Philips Corporation, New York, N.Y.

[ * ] Notice: Under 35 U.S.C. 154(b), the term of this patent shall be extended for 433 days.

[21] Appl. No.: 08/629,260

[22] Filed: Apr. 8, 1996

[30] Foreign Application Priority Data

Nov. 28, 1995 [EP] European Pat. Off. ..... 95203274

[51] Int. Cl.[7] ..... A61B 17/50

[52] U.S. Cl. ..... 606/133; 601/46

[58] Field of Search ..... 606/133, 131, 606/43, 42, 36, 1, 41, 51–52, 46, 45, 47–50; 601/68–70

[56] References Cited

U.S. PATENT DOCUMENTS

| | | | |
|---|---|---|---|
| 919,649 | 4/1909 | Sciple | 601/68 |
| 4,052,982 | 10/1977 | Ozeryansky | 128/57 |
| 4,901,723 | 2/1990 | Platek | 606/133 |
| 5,011,485 | 4/1991 | Daar et al. | 606/133 |
| 5,088,999 | 2/1992 | Bukoschek et al. | 606/133 |
| 5,281,233 | 1/1994 | Dolev | 606/131 |
| 5,346,499 | 9/1994 | Garenfeld et al. | 606/131 |
| 5,356,415 | 10/1994 | Iwasaki et al. | 606/131 |
| 5,405,311 | 4/1995 | Pecora et al. | 601/135 |

FOREIGN PATENT DOCUMENTS

| | | |
|---|---|---|
| 0493849 | 7/1992 | European Pat. Off. . |
| 0532106 | 3/1993 | European Pat. Off. . |

*Primary Examiner*—Justine R. Yu
*Attorney, Agent, or Firm*—Ernestine C. Bartlett

[57] ABSTRACT

Depilation apparatus with a housing and a depilation member for gripping hairs on human skin and pulling the hairs from the skin comprises a vibration member for exerting mechanical vibrations on the skin. Such mechanical vibrations have an anaesthetizing effect on the skin so that pain sensations caused by the process of pulling hairs from the skin are relieved. The vibration member comprises flexible protrusions which have been disposed on a carrier. In this way, the mechanical vibrations are introduced into the skin in distinct concentrated positions on the skin.

20 Claims, 6 Drawing Sheets

DEPILATION APPARATUS WITH VIBRATION MEMBER

Figure 1:
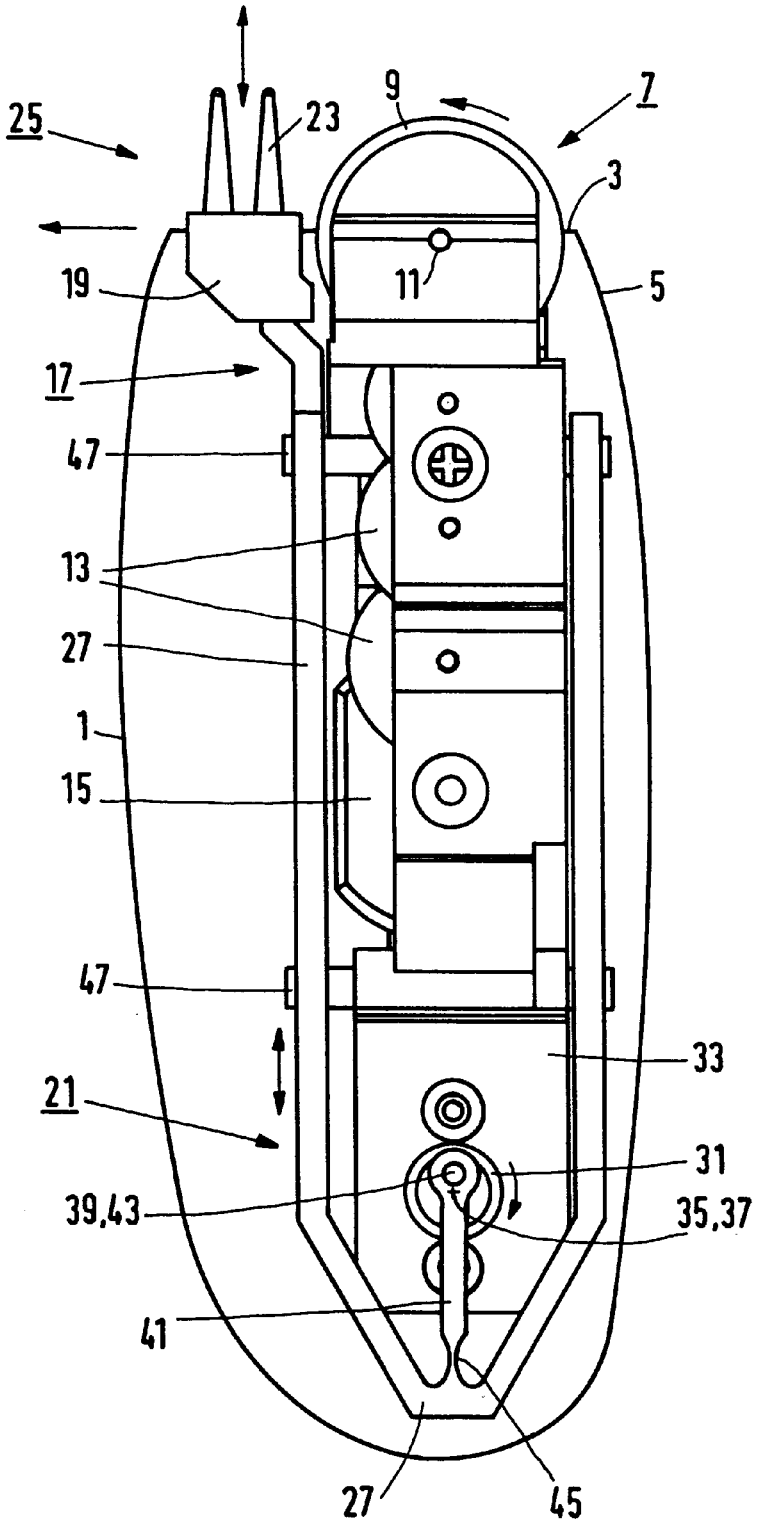

The invention relates to a depilation apparatus comprising a housing, a depilation member for gripping hairs on human skin and pulling the hairs from the skin, and a vibration member for exerting mechanical vibrations on the skin.

A depilation apparatus of the kind mentioned in the opening paragraph is known from EP-A-0 493 849. In the known depilation apparatus, the depilation member comprises a pair of cooperating rollers, while the vibration member comprises a screen plate which comprises hair passage openings and which prevents the skin from being gripped by the depilation member. The screen plate is pivotable with respect to the housing of the apparatus and is drivable by an electric motor of the apparatus into a pivoting oscillating movement. When the known depilation apparatus is placed on the skin to be depilated, the screen plate exerts mechanical vibrations on the skin. Said mechanical vibrations have an anaesthetizing effect on the skin, relieving pain sensations experienced when hair is being pulled from the skin by the depilation member.

A disadvantage of the known depilation apparatus is that the oscillating screen plate is comfortable on parts of the skin which overlie a relatively soft tissue and hence are relatively insensitive to mechanical vibrations, but rather uncomfortable on parts of the skin which closely overlie a bone and hence are relatively sensitive to mechanical vibrations.

It is an object of the invention to provide a depilation apparatus of the kind mentioned in the opening paragraph with an improved vibration member which has an adequate anaesthetizing effect and is comfortable both on parts of the skin which closely overlie a bone and on parts of the skin which overlie a relatively soft tissue.

According to the invention, the depilation apparatus is characterized in that the vibration member comprises flexible protrusions which are disposed on a carrier, and means for vibrating the carrier. The protrusions cause the mechanical vibrations of the vibration member to be introduced into the skin in distinct, concentrated positions on the skin. On parts of the skin which overlie a relatively soft tissue and hence are relatively insensitive to mechanical vibrations, the flexible protrusions are not bent so that the mechanical vibrations penetrate deeply into the skin and into the underlying tissue, and an adequate anaesthetizing effect is achieved. On parts of the skin which closely overlie a bone and hence are relatively sensitive to mechanical vibrations, the flexible protrusions are bent, so that uncomfortable mechanical vibrations of the bone underlying the skin are limited as far as possible.

A particular embodiment of a depilation apparatus according to the invention is characterized in that the protrusions are disposed in a regular pattern. Since the protrusions are disposed in a regular pattern, the mechanical vibrations are uniformly distributed over a part of the skin which is vibrated by the vibration member, so that an anaesthetizing effect on the skin is achieved which is also uniformly distributed over said part of the skin.

A further embodiment of a depilation apparatus according to the invention is characterized in that the protrusions have a conical shape. Due to the conical shape of the flexible protrusions, the flexible protrusions have a mechanical stiffness which enables them to bend on parts of the skin which closely overlie a bone, but not on parts of the skin which overlie a relatively soft tissue. In this way, the flexible protrusions have a suitable and reliable bending characteristic.

A yet further embodiment of a depilation apparatus according to the invention is characterized in that the protrusions each have a rounded end portion. The rounded end portions of the protrusions further improved, the comfort of the depilation apparatus.

A particular embodiment of a depilation apparatus according to the invention is characterized in that the protrusions comprise an elastomeric material. The comfort of the depilation apparatus is further improved by the use of the elastomeric material.

A further embodiment of a depilation apparatus according to the invention is characterized in that the means for vibrating the carrier comprise a lever which is pivotable about a first axis, an eccentric member which is rotatable by an electric motor about a second axis extending substantially parallel to the first axis and which comprises a mounting member disposed eccentrically relative to the second axis, and a mechanical spring prestressed between the lever and the mounting member. Since the mechanical spring is prestressed between the lever and the mounting member of the eccentric member, the mechanical spring exerts a mechanical moment on the lever which is alternately directed in a positive direction and in an opposed, negative direction about the first axis when the eccentric member is being rotated by the electric motor. As a result of said alternating mechanical moment of the spring, the lever vibrates about the first axis. By guiding the carrier of the vibration member relative to the housing and coupling the carrier to the lever, it is achieved that the mechanical vibrations of the lever are transmitted to the carrier and the flexible protrusions. Since the lever is coupled to the eccentric member via the mechanical spring, the position of the vibration member relative to the housing is not kinematically defined. Contact between the vibration member and the skin will be maintained under the influence of a prestressing force of the mechanical spring when the position of the depilation apparatus relative to the skin is changed.

A yet further embodiment of a depilation apparatus according to the invention is characterized in that the mechanical spring is a helical spring extending substantially perpendicular to the first axis, the mounting member being mounted to the eccentric member so as to be pivotable about a third axis extending substantially parallel to the first axis. When the eccentric member is being rotated by the electric motor, the helical spring extends alternately at one side of the lever and at the opposite other side of the lever seen in an imaginary plane extending perpendicular to the first axis. In this way, the alternating mechanical moment exerted by the spring on the lever about the first axis is achieved in a practical and predictable manner.

A particular embodiment of a depilation apparatus according to the invention is characterized in that the lever is mounted to an adjustment member so as to be pivotable about the first axis, the adjustment member being displaceable relative to the housing in a direction perpendicular to the first axis. By adjusting the adjustment member, it is achieved that the first axis is displaced relative to the second axis in a direction perpendicular to the first axis. In this way, the position of the mechanical spring relative to the lever and relative to the first axis is altered, so that the mechanical moment exerted by the spring on the lever about the first axis is altered. The adjustment member is constructed such that, for example, the first axis is displaceable from a first position in which the first axis substantially coincides with the second axis, into a second position in which the mounting member of the eccentric member is always at one side of the lever seen in an imaginary plane extending perpendicular to the first axis. In said first position of the first axis, the spring exerts an alternating mechanical moment on the lever, so that the lever vibrates. In said second position of the first axis, the spring exerts a mechanical moment on the lever in a constant direction about the first axis, so that the lever is held in a constant extreme position relative to the housing such as, for example, a position in which the vibration member is withdrawn into the housing. In this way, the vibration member is switchable from an active position in which the skin is vibrated to an inactive position in which the vibration member is withdrawn into the housing in a practical manner with a minimum number of additional constructional parts.

A further embodiment of a depilation apparatus according to the invention is characterized in that the means for vibrating the carrier comprise a lever which is pivotable about a first axis, a cam which is rotatable by an electric motor about a second axis substantially coinciding with the first axis, a cam follower which is displaceable relative to the lever in a direction perpendicular to the first axis, and a mechanical spring prestressed between the lever and the cam follower. The carrier of the vibration member is coupled to the lever also in this embodiment. When the cam is being rotated by the electric motor, the cam follower and the lever are repetitively taken along in rotational direction by the cam until the vibration member abuts against the skin. Whenever the vibration member abuts against the skin, the cam follower leaps over the cam against a prestressing force of the mechanical spring, whereupon the cam follower and the lever pivot in a direction opposed to said rotational direction. In this way, the lever and the vibration member coupled to the lever vibrate with a frequency determined by a rotational frequency of the cam. In this embodiment, again, the position of the vibration member relative to the housing is not kinematically defined. Contact between the vibration member and the skin will be maintained when the position of the depilation apparatus relative to the skin is changed because the cam follower and the lever are always taken along by the cam until the vibration member abuts against the skin.

A yet further embodiment of a depilation apparatus according to the invention is characterized in that the means for vibrating the carrier comprise a mechanical stop for limiting a range of movement of the vibration member. The mechanical stop limits the kinematically indefinite position of the vibration member when the vibration member is not in contact with the skin in a simple and practical manner.

A particular embodiment of a depilation apparatus according to the invention is characterized in that the carrier is mounted to the lever so as to be pivotable about a fourth axis extending substantially parallel to the first axis, the means for vibrating the carrier further comprising a guiding member which is mounted to the carrier so as to be pivotable about a fifth axis extending substantially parallel to the first axis and is mounted to the housing so as to be pivotable about a sixth axis extending substantially parallel to the first axis. The carrier, the lever, the guiding member and the housing together form a parallelogram mechanism. By using said parallelogram mechanism, it is achieved that a pivoting motion of the lever is converted into a substantially rectilinear motion of the carrier and the vibration member, so that the depilation apparatus can dispense with additional constructional means for guiding the vibration member relative to the housing.

A further embodiment of a depilation apparatus according to the invention is characterized in that the means for vibrating the carrier comprise an eccentric member which is rotatable by an electric motor about a first axis and comprises a mounting member disposed eccentrically relative to the first axis, the means for vibrating the carrier further comprising a coupling member which is mounted to the mounting member so as to be pivotable about a second axis extending substantially parallel to the first axis and is mounted to the carrier so as to be pivotable about a third axis extending substantially parallel to the first axis, the carrier being guided relative to the housing in a direction perpendicular to the first axis. Said eccentric member, said mounting member, said coupling member and said carrier constitute a simple and practical solution for obtaining a kinematically defined vibration of the vibration member.

A yet further embodiment of a depilation apparatus according to the invention is characterized in that the eccentric member is rotatably journalled relative to a lever about the first axis, the lever is pivotable about a fourth axis extending parallel to the first axis, and a mechanical spring is prestressed between the lever and the housing. By using said pivotable lever and said mechanical spring, it is achieved that the vibration member is displaceable relative to the housing against a prestressing force of the mechanical spring. In this way, it is achieved also in this embodiment that contact between the vibration member and the skin will be maintained under the influence of said prestressing force when the position of the depilation apparatus relative to the skin is changed.

Figure 2A:
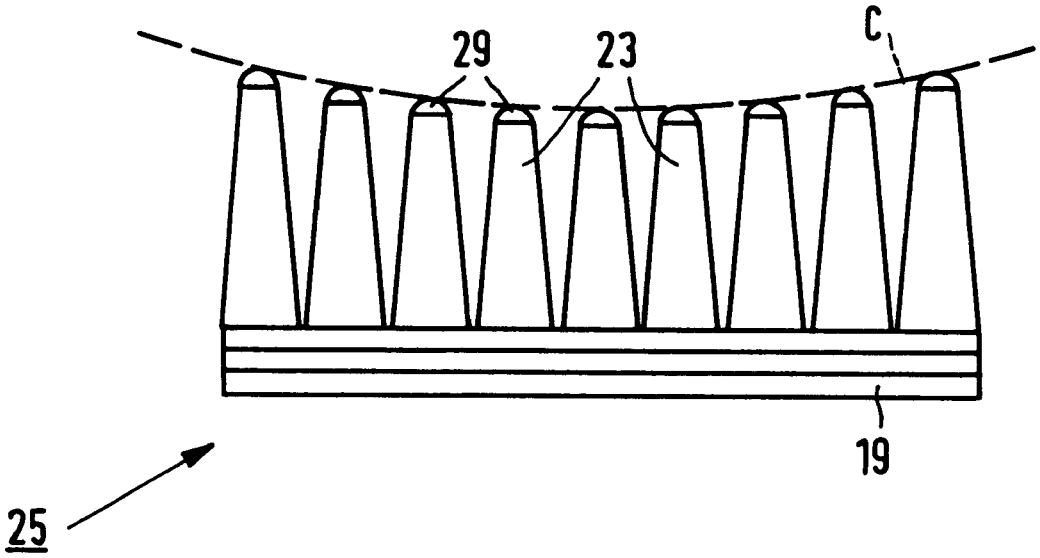
Figure 2B:
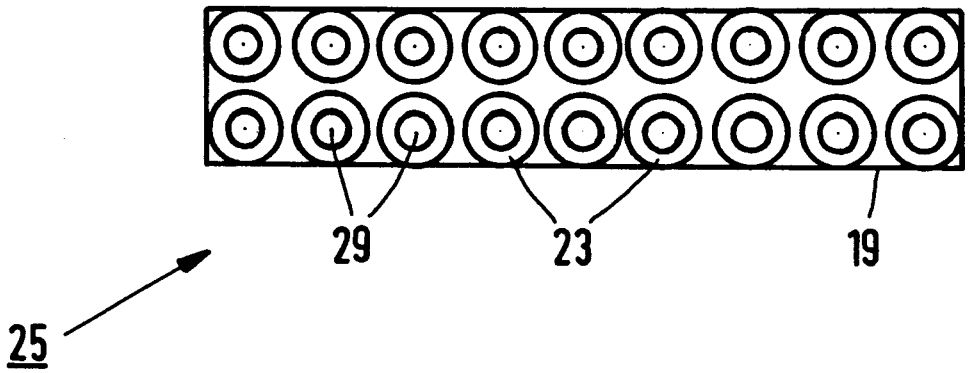
Figure 3:
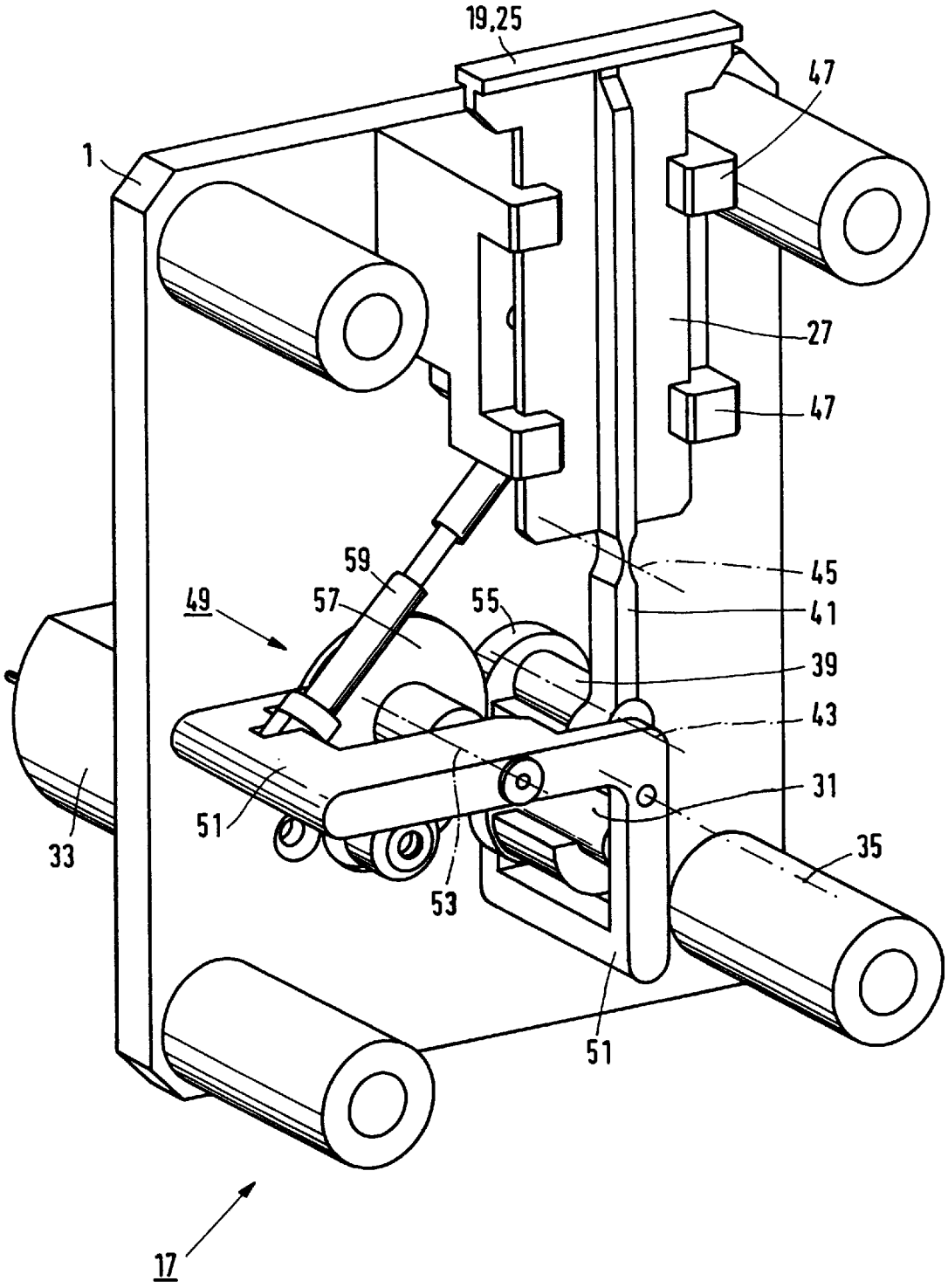
Figure 4:
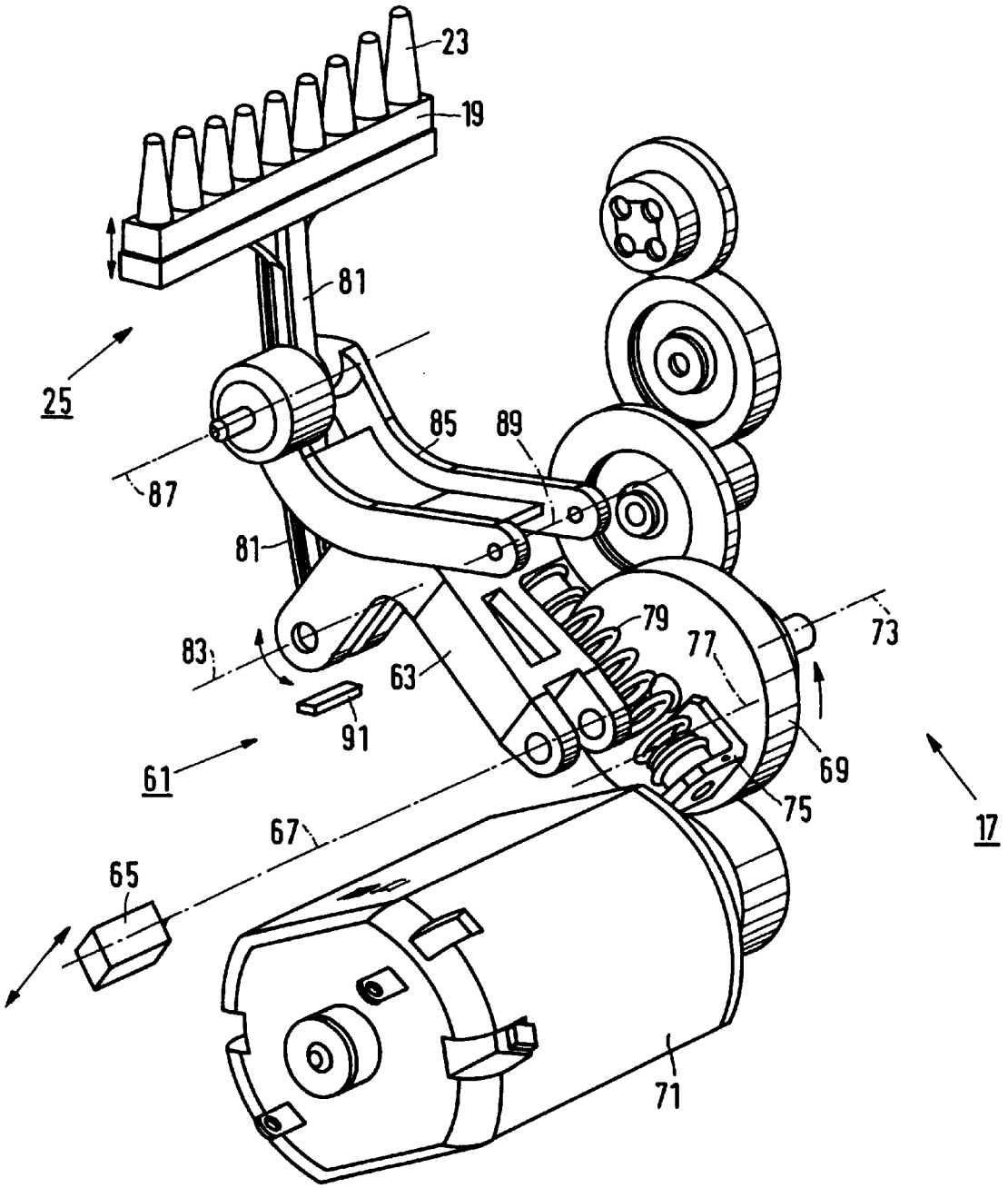
Figure 5A:
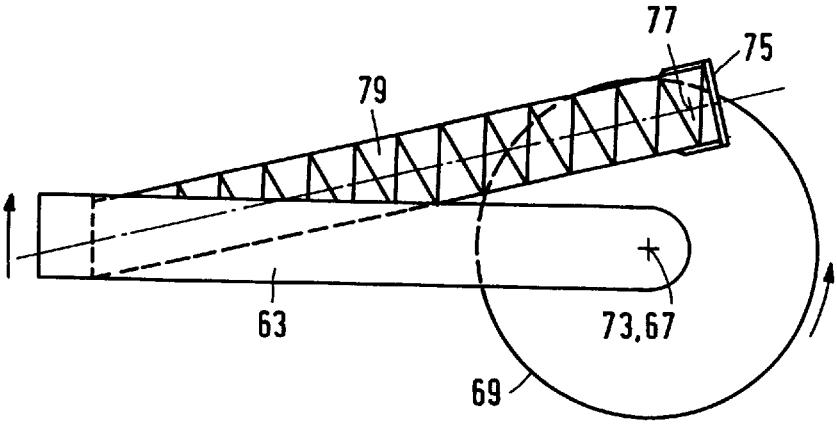
Figure 5B:
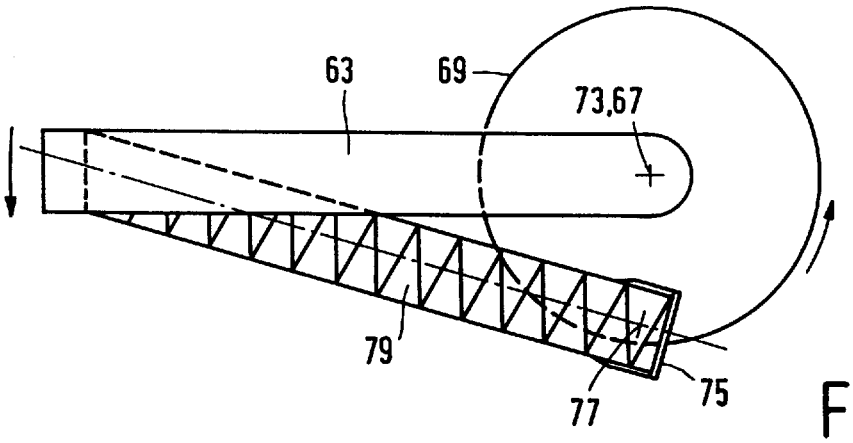
Figure 5C:
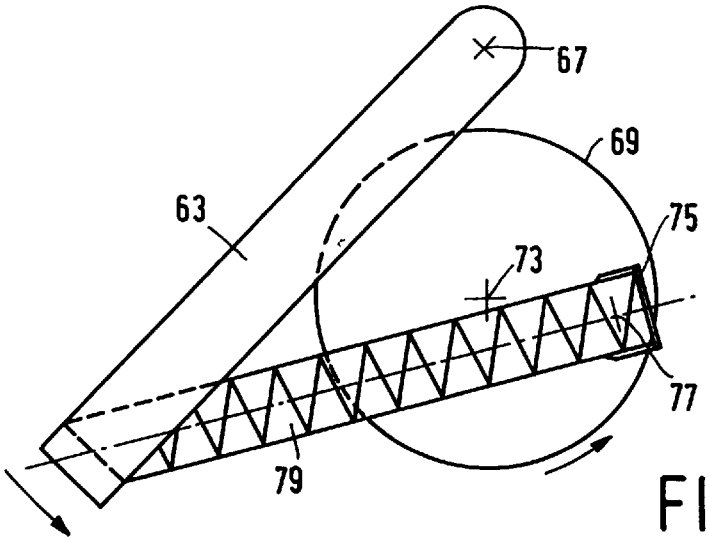
Figure 6:
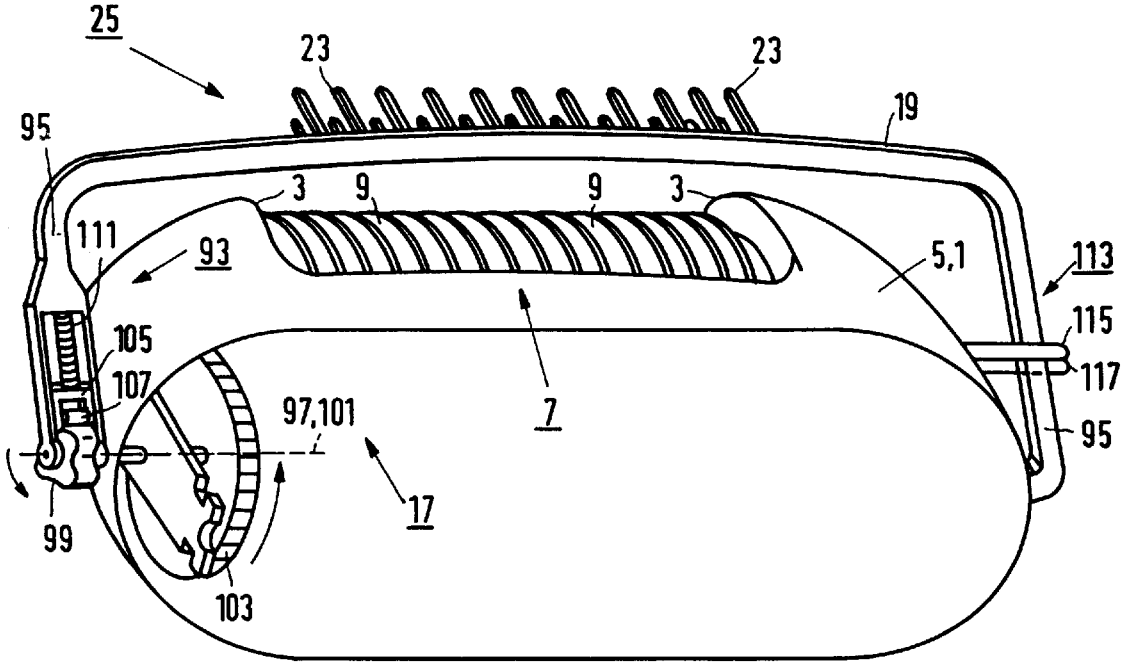
Figure 7:
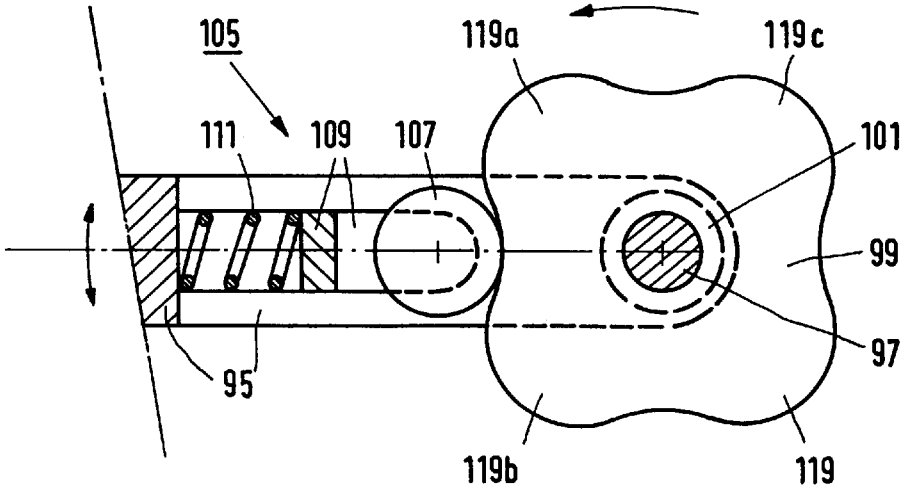

The invention will be explained in more detail below with reference to the drawing, in which FIG. 1 shows a side view of a first embodiment of a depilation apparatus according to the invention, FIG. 2*a* is a front view of a vibration end piece of the depilation apparatus of FIG. 1, FIG. 2*b* is a top view of the vibration end piece of FIG. 2*a*, FIG. 3 shows a vibration member of a second embodiment of a depilation apparatus according to the invention, FIG. 4 shows a vibration member of a third embodiment of a depilation apparatus according to the invention, FIG. 5*a* diagrammatically shows the vibration member of FIG. 4 wherein a pivot axis of the lever is in a first position and an eccentric member is in a first rotational position, FIG. 5*b* diagrammatically shows the vibration member of FIG. 5*a* wherein the pivot axis of the lever is in the first position and the eccentric member is in a second rotational position, FIG. 5*c* diagrammatically shows the vibration member of FIG. 5*a* wherein the pivot axis of the lever is in a second position, FIG. 6 shows a vibration member of a fourth embodiment of a depilation apparatus according to the invention, and FIG. 7 shows a cross-section of a cam and a cam follower of the vibration member of FIG. 6.

As FIG. 1 shows, the first embodiment of a depilation apparatus according to the invention comprises a housing 1 with a depilation opening 3 which is provided in a depilation head 5 of the depilation apparatus. A depilation member 7 is disposed in the depilation head 5. The depilation member 7 is of a type which is known per se from EP-A-0 532 106 and comprises a number of cooperating discs 9 which are coupled to a drive shaft 11 extending parallel to the depilation opening 3. The drive shaft 11 is rotatable relative to the housing 1 by means of an electric motor 15 via a number of gear wheels 13. The discs 9 are pivotable relative to the drive shaft 11 upon rotation of the drive shaft 11 so as to grip hairs growing on human skin and exposed to the depilation member 7 via the depilation opening 3, and pull these hairs from the skin. It is noted that in FIG. 1 only one disc 9 is visible. Further details about the construction and operation of the depilation member 7, and in particular about the cooperation of the discs 9 are given in EP-A-0 532 106, which is therefore incorporated in the present description by reference.

As FIG. 1 further shows, the depilation apparatus comprises a vibration member 17 for exerting mechanical vibrations on the skin when hairs are being gripped and pulled from the skin by the depilation member 7. The process of pulling hairs from the skin is in itself painful. Pain sensations caused by the process of pulling hairs from the skin are relieved by mechanical vibrations exerted on the skin under-treatment. The relief of pain sensations occurs because human nerves have a limited transmission capacity. When mechanical vibrations are being exerted on the skin during the process of pulling hairs from the skin, the nerves have to transmit nerve stimuli corresponding to the pain sensations caused by the process of pulling hairs from the skin as well as nerve stimuli corresponding to relatively comfortable sensations caused by the process of exerting mechanical vibrations on the skin. Due to the limited transmission capacity of the nerves, said nerve stimuli corresponding to the pain sensations are suppressed by said nerve stimuli corresponding to the comfortable sensations of the mechanical vibrations, so that said pain sensations are relieved. In this way, the mechanical vibrations have an anaesthetizing effect on the process of pulling hairs from the skin.

As FIG. 1 shows, the vibration member 17 comprises a carrier 19 and means 21 for vibrating the carrier 19 in a vibration direction substantially perpendicular to the skin, as shown in FIG. 1. Said means 21 for vibrating the carrier 19 will be described in more detail below. The vibration member 17 further comprises a plurality of flexible protrusions 23 disposed on the carrier 19 in a regular pattern and made from an elastomeric material such as, for example, silicone rubber. The carrier 19 and the flexible protrusions 23 together form a vibration end piece 25 of the vibration member 17, the end piece 25 being detachably mounted on a connecting piece 27 of the vibration member 17. As FIG. 2*b* shows, the end piece 25 comprises two rows of nine protrusions 23 each. As FIG. 2*a* and FIG. 2*b* show, the protrusions 23 have a circular cross-section, a conical shape and a rounded end portion 29. Via the flexible protrusions 23, mechanical vibrations of the vibration member 17 are introduced into the skin in distinct, concentrated positions on the skin which correspond to the regular pattern of the protrusions 23. In this way, said mechanical vibrations are uniformly distributed over a part of the skin which is vibrated, so that the anaesthetizing effect of the mechanical vibrations is uniformly distributed over said part of the skin. Since the mechanical vibrations are introduced into the skin in distinct concentrated positions, an adequate anaesthetizing effect is achieved on parts of the skin which overlie a relatively soft human tissue and which therefore are relatively insensitive to mechanical vibrations. On such parts of the skin, the flexible protrusions 23 are not bent so that the mechanical vibrations penetrate deeply into the skin. On parts of the skin which closely overlie a human bone and therefore are relatively sensitive to mechanical vibrations, on the other hand, the flexible protrusions 23 will bend. In this way, mechanical vibrations of the bone underlying the skin, which are rather uncomfortable, are prevented as far as possible, while an adequate anaesthetizing effect is nevertheless achieved in the skin overlying the bone. The mechanical vibrations are smoothly introduced in said distinct concentrated positions on the skin by the rounded end portions 29 of the protrusions 23, so that the comfort of the depilation apparatus is further improved. A favourable mechanical stiffness and favourable bending characteristics of the flexible protrusions 23 are achieved owing to the conical shape of the protrusions 23 and the use of the elastomeric material. Said mechanical stiffness is great enough for the protrusions 23 not to bend on parts of the skin which overlie a relatively soft tissue, and small enough for the protrusions 23 to bend on parts of the skin which closely overlie a bone.

As FIG. 2*a* further shows, the protrusions 23 have different lengths, the outermost protrusions 23 of each row having a maximum length, the central protrusion 23 of each row having a minimum length, and the length of the other protrusions 23 varying gradually from said minimum length to said maximum length. In this way, as shown in FIG. 2*a*, the protrusions 23 together have a curved outer contour C which approximates roughly a curved contour of a human arm or leg, so that on a human arm or leg all protrusions 23 of the end piece 25 are effectively used for transmitting mechanical vibrations to the skin.

As FIG. 1 further shows, the vibration end piece 25 is disposed immediately adjacent to the depilation member 7. It is noted that the anaesthetizing effect of the vibration member 17 is experienced most strongly when the depilation member 7 is moved over the skin in a direction towards the vibration member 17, so that a given part of the skin has been vibrated before the hairs on said part are pulled out. When the depilation member 7 is moved over the skin in an opposite direction away from the vibration member 17, the anaesthetizing effect of the vibration member 17 is much weaker. For a user of the depilation apparatus, therefore, said direction towards the vibration member 17 is a prescribed direction in which the user has to move the depilation apparatus in order to obtain a comfortable depilatory action of the apparatus.

As FIG. 1 further shows, the means 21 for vibrating the carrier 19 of the vibration member 17 comprise an eccentric member 31 which is rotatable relative to the housing 1 by a further electric motor 33 about a first axis 35. The first axis 35 extends in a direction perpendicular to the vibration direction of the carrier 19 and parallel to a longitudinal direction of the carrier 19, so that in FIG. 1 only a point of intersection 37 between the first axis 35 and the eccentric member 31 is shown. The eccentric member 31 comprises a mounting member 39 which is disposed eccentrically relative to the first axis 35. The means 21 for vibrating the carrier 19 further comprise a coupling member 41 which is mounted to the mounting member 39 so as to be pivotable about a second axis 43 extending substantially parallel to the first axis 35. Furthermore, the coupling member 41 is mounted to the connecting piece 27 of the vibration member 17 so as to be pivotable about a third axis 45 extending substantially parallel to the first axis 35. As shown in FIG. 1, the third axis 45 is formed by an elastically deformable reduced portion of the coupling member 41. As FIG. 1 further shows, the means 21 for vibrating the carrier 19 comprise a guide 47 by means of which the connecting piece 27 and the carrier 19 are guided relative to the housing 1 in the vibration direction of the carrier 19. When the eccentric member 31 is rotated by the electric motor 33 about the first axis 35, the rotational motion of the eccentric member 31 is converted into a rectilinear vibratory motion of the connecting piece 27 and the carrier 19, the carrier 19 making a vibratory motion with a kinematically defined amplitude and a kinematically defined central position relative to the housing 1.

A second, a third and a fourth embodiment of a depilation apparatus according to the invention will now be described. The second, third and fourth embodiments of the depilation apparatus each have a housing 1, a depilation member 7 and a vibration end piece 25 similar to the housing 1, the depilation member 7 and the vibration end piece 25 of the first embodiment of the depilation apparatus described before. The second, third and fourth embodiments of the depilation apparatus differ from the first embodiment of the depilation apparatus in that the second, third and fourth embodiments have means 49, 61, 93 for vibrating the carrier 19 which differ from the means 21 for vibrating the carrier 19 in the first embodiment. Therefore, only the means 49, 61, 93 for vibrating the carrier 19 in the second, third and fourth embodiments will be described below, corresponding components of the four embodiments being indicated by corresponding reference numerals.

As FIG. 3 shows, the means 49 for vibrating the carrier 19 of the second embodiment of the depilation apparatus according to the invention comprise a connecting piece 27, an eccentric member 31, an electric motor 33, a first axis 35, a mounting member 39, a coupling member 41, a second axis 43, a third axis 45 and a guide 47 which cooperate in a manner similar to the cooperation of the corresponding components in the first embodiment of the depilation apparatus. It is noted that in FIG. 3 the protrusions 23 of the vibration end piece 25 are not shown. As FIG. 3 further shows, the eccentric member 31 is rotatably journalled relative to a lever 51 about the first axis 35, said lever 51 being pivotably journalled relative to the housing 1 about a fourth axis 53 extending parallel to the first axis 35. The eccentric member 31 comprises a gear wheel 55 which is concentric relative to the first axis 35. The gear wheel 55 cooperates with a further gear wheel 57 which is rotatably journalled relative to the housing 1 about the fourth axis 53 and is drivable by the electric motor 33. Finally, a mechanical spring 59 is prestressed between the lever 51 and the housing 1. When the electric motor 33 is rotating, the eccentric member 31 is driven by the electric motor 33 via the gear wheels 55 and 57 and the rotational motion of the eccentric member 31 is converted into a rectilinear vibratory motion of the connecting piece 27 and the carrier 19. The end piece 25 rests against the skin under the influence of a prestressing force of the mechanical spring 59. When the position of the depilation apparatus relative to the skin is changed, contact between the vibration member 17 and the skin will be maintained because, under the influence of said prestressing force, the lever 51 with the eccentric member 31 will pivot about the fourth axis 53 and consequently the end piece 25 will be displaced relative to the housing 1. In this way, the vibratory motion of the end piece 25 of the second embodiment of the depilation apparatus has an amplitude which is kinematically defined, and a central position relative to the housing 1 which is not kinematically defined and depends on the position of the housing 1 relative to the skin. It is noted that a mechanical stop may be applied to limit a range of movement of the end piece 25 relative to the housing 1, for example, a mechanical stop cooperating with the lever 51.

As FIG. 4 shows, the means 61 for vibrating the carrier 19 of the third embodiment of the depilation apparatus according to the invention comprise a lever 63 which is mounted to an adjustment member 65 so as to be pivotable about a first axis 67, and an eccentric member 69 which is rotatable by an electric motor 71 about a second axis 73 extending substantially parallel to the first axis 67. The second axis 73 is in a fixed position relative to the housing 1. The adjustment member 65 is guided relative to the housing 1 in a direction perpendicular to the first axis 67 as shown in FIG. 4. The adjustment member 65 is displaceable in said direction together with the first axis 67 via a control knob which is not shown in FIG. 4 and which can be operated by the user of the depilation apparatus. The first axis 67, the second axis 73, and the adjustment member 65 are shown diagrammatically only in FIG. 4. The function of the adjustment member 65 will be explained below.

As FIG. 4 shows, the means 61 for vibrating the carrier 19 further comprise a mounting member 75 which is disposed eccentrically relative to the second axis 73 and is mounted to the eccentric member 69 so as to be pivotable about a third axis 77 extending substantially parallel to the first axis 67. A helical spring 79 is prestressed between said mounting member 75 and the lever 63 and extends substantially perpendicular to the first axis 67. Furthermore, the carrier 19 is fixedly mounted to a connecting rod 81, the rod 81 being pivotably mounted to the lever 63 about a fourth axis 83 extending substantially parallel to the first axis 67. The means 61 for vibrating the carrier 19 further comprise a guiding member 85 which is mounted to the rod 81 and the carrier 19 so as to be pivotable about a fifth axis 87 extending substantially parallel to the first axis 67, and is mounted to the housing 1 so as to be pivotable about a sixth axis 89 extending substantially parallel to the first axis 67.

The operation of the means 61 for vibrating the carrier 19 of the third embodiment of the depilation apparatus will be explained with reference to FIG. 5*a*, FIG. 5*b* and FIG. 5*c* in which the mutual positions of the lever 63, the eccentric member 69 and the spring 79 are diagrammatically shown. In FIG. 5*a* and FIG. 5*b*, the adjustment member 65 is in a position in which the first axis 67 coincides substantially with the second axis 73. When the eccentric member 69 is being rotated by the electric motor 71, the mounting member 75 of the eccentric member 69 and the spring 79 are situated alternately at a first side of the lever 63 as shown in FIG. 5*a*, and at a second side of the lever 63 as shown in FIG. 5*b*, seen in an imaginary plane extending perpendicular to the first axis. Since the spring 79 is prestressed between the lever 63 and the mounting member 75, the spring 79 exerts a mechanical moment on the lever 63 about the first axis 67 which is alternately directed in a positive direction in FIG. 5*a* and in a negative direction in FIG. 5*b*. As a result of said alternating mechanical moment of the spring 79, the lever 63 vibrates about the first axis 67. As shown in FIG. 4, the connecting rod 81, the lever 63, the guiding member 85 and the housing 1 together form a parallelogram mechanism by means of which the carrier 19 is guided relative to the housing 1 in a direction perpendicular to the first axis 67, and by means of which the pivoting vibratory motion of the lever 63 is converted into a substantially rectilinear vibratory motion of the carrier 19 in said direction. The vibratory motion of the carrier 19 has a frequency corresponding to a rotational frequency of the eccentric member 69. An amplitude and central position of the carrier 19 relative to the housing 1 are not kinematically defined. The amplitude of the vibratory motion of the carrier 19 is determined by a mass moment of inertia of said parallelogram mechanism, a stiffness of the spring 79, the rotational frequency of the eccentric member 69, and an external load exerted on the carrier 19. The central position of the carrier 19 relative to the housing 1 is also influenced by said external load. When the end piece 25 is brought into contact with the skin, the central position of the carrier 19 changes. Under the influence of a prestressing force of the spring 79, contact between the end piece 25 and the skin is maintained when the position of the depilation apparatus relative to the skin is changed.

In FIG. 5*c*, the first axis 67 has been displaced relative to the second axis 73 in a direction perpendicular to the first axis 67, the adjustment member 65 being in a position in which the mounting member 75 of the eccentric member 69 and the spring 79 are situated at the second side of the lever 63 in every rotational position of the eccentric member 69, seen in an imaginary plane extending perpendicular to the first axis 67. In this position of the adjustment member 65, the spring 79 exerts a mechanical moment on the lever 63 in the negative direction in every rotational position of the eccentric member 69. Under the influence of said mechanical moment, the lever 63, and consequently also the end piece 25 are held in an extreme position relative to the housing 1, in which the end piece 25 is withdrawn into the housing. In this extreme position, the connecting rod 81 rests against a mechanical stop 91 of the housing 1, shown diagrammatically in FIG. 4, under the influence of the prestressing force of the spring 79 so that mechanical vibrations of the end piece 25 under the influence of the rotation of the eccentric member 69 are prevented. In this way, the user of the depilation apparatus can switch the vibration member 17 from an active position shown in FIG. 5*a* and FIG. 5*b*, in which the skin is vibrated by the end piece 25, to an inactive position shown in FIG. 5*c*, in which the vibration member 17 is withdrawn into the housing 1.

It is noted that in FIG. 5*a*, FIG. 5*b* and FIG. 5*c*, the spring 79 is shown as a tension spring. The spring 79 may also be a compression spring, in which case the directions in which the mechanical moment of the spring 79 is exerted on the lever 63 are inverted.

FIG. 6 diagrammatically shows the vibration member 17 of the fourth embodiment of the depilation apparatus according to the invention. The means 93 for vibrating the carrier 19 of the fourth embodiment comprise a lever 95 which is journalled relative to the depilation head 5 of the housing 1 so as to be freely pivotable about a first axis 97. Furthermore, the means 93 for vibrating the carrier 19 comprise a cam 99 which is rotatable about a second axis 101 coinciding or almost coinciding with the first axis 97. As distinct from the lever 95, the cam 99 is not freely rotatable about the second axis 101 but is drivable via a gear wheel 103 by an electric motor not shown in FIG. 6. As FIG. 6 further shows, a cam follower 105 is displaceably guided relative to the lever 95 in a direction perpendicular to the first axis 97. The cam 99 and the cam follower 105 are shown in detail in FIG. 7. The cam follower 105 comprises a roller member 107 which is journalled so as to be freely rotatable relative to a holder 109. The holder 109 is guided so as to be freely displaceable relative to the lever 95 in a direction perpendicular to the first axis 97. Between the lever 95 and the holder 109, a mechanical spring 111 is prestressed so that the roller member 107 of the cam follower 105 is in contact with the cam 99 under the influence of a prestressing force of the spring 111. As FIG. 6 further shows, the means 93 for vibrating the carrier 19 comprise a mechanical stop 113 having a first arm 115 and a second arm 117 disposed at two respective sides of the lever 95. The first and second arms 115 and 117, which are shown diagrammatically only in FIG. 6, limit a range of movement of the lever 95 and the vibration end piece 25.

When the cam 99 is being rotated by said electric motor, the cam follower 105 and, consequently, the lever 95 are initially taken along in a rotational direction of the cam 99 by a boss 119*a* of the cam 99 since the roller member 107 of the cam follower 105 is locked relative to the cam 99 between said boss 119*a* and an adjacent boss 119*b* of the cam 99 under the influence of the prestressing force of the spring 111. When subsequently the lever 95 abuts against the mechanical stop 113 or the end piece 25 abuts against the skin, the lever 95 is stopped so that the roller member 107 of the cam follower 105 leaps over said boss 119*a* against the prestressing force of the spring 111. Subsequently, the cam follower 105 and the lever 95 are pivoted in a direction opposite to the rotational direction of the cam 99 since the roller member 107 leaps between said boss 119*a* and an adjacent boss 119*c*. During one revolution of the cam 99, this process is repeated a number of times corresponding to the number of bosses 119 of the cam 99. In this way, the lever 95 and the end piece 25 vibrate with a frequency which is determined by a rotational frequency of the cam 99 and the number of bosses 119 of the cam 99. Contact between the end piece 25 and the skin will be maintained when the position of the depilation apparatus relative to the skin is changed because the cam follower 105 and the lever 95 are always taken along by the cam 99 until the end piece 25 abuts against the skin. The mechanical stop 113 limits in a simple and practical manner the kinematically indefinite position of the lever 95 relative to the housing 1 when the end piece 25 is not in contact with the skin.

In the four embodiments of the depilation apparatus described above, the depilation member 7 is of a type which is known per se from EP-A-0 532 106, and comprises a number of cooperating discs 9 which are coupled to a drive shaft 11 extending parallel to the depilation opening 3. It is noted that the invention is also applicable in a depilation apparatus having a different kind of depilation member such as, for example, a depilation member with cooperating rollers as disclosed in EP-A-0 493 849 or a depilation member with cooperating discs of a kind as disclosed in EP-A-0 328 426.

According to the invention, the vibration member 17 is provided with flexible protrusions 23 disposed on a carrier 19. In the four embodiments of the depilation apparatus described above, the protrusions 23 are flexible in that the protrusions 23 have been made from an elastomeric material. It is noted that, in accordance with the invention, the protrusions 23 may alternatively be made from a relatively rigid material. In such an embodiment, for example, the protrusions 23 are each disposed on the carrier 19 via an elastically deformable reduced portion of the protrusions 23. In an alternative embodiment of the invention, the protrusions 23 are flexible in that the carrier 19 is mounted to the means 21, 49, 61, 93 for vibrating the carrier 19 via an elastically deformable element, or in that the means 21, 49, 61, 93 for vibrating the carrier 19 themselves comprise an elastically deformable element. According to the invention, therefore, the protrusions 23 may be made from a relatively rigid material, while, for example, the connecting rod 81 of the means 61 for vibrating the carrier 19 is provided with an elastically deformable element.

In the four embodiments of the depilation apparatus described above, the protrusions 23 comprise an elastomeric material such as, for example, silicone rubber. It is noted that, in accordance with the invention, the protrusions 23 may also be made from another material such as, for example, a composition of different kinds of rubber, a synthetic resin or another kind of synthetic material.

It is further noted that, according to the invention, the depilation member and the vibration member of the depilation apparatus may be driven by two separate electric motors or by a single, common electric motor.

It is further noted that, according to the invention, the carrier 19 carrying the protrusions 23 may be fixedly mounted to the means 21, 49, 61, 93 for vibrating the carrier 19 or may be detachably mounted to said means. When the carrier 19 is detachably mounted to said means, different carriers 19 may be used comprising, for example, protrusions 23 with different outer contours C approximating contours of other parts of the body.

It is further noted that, according to the invention, alternative patterns of protrusions 23 may be used such as, for example, a single row of protrusions 23 as shown in the embodiment of FIG. 4, a square pattern of protrusions or an oval pattern of protrusions. The pattern of protrusions may be regular or irregular. Furthermore, instead of the protrusions 23 with a circular cross-section and a conical shape, protrusions may be used with an alternative cross-section such as, for example, a cross-shaped cross-section or a square cross-section.

In the first embodiment of the depilation apparatus according to the invention, the vibratory motion of the vibration end piece 25 is kinematically defined so that the position of the end piece 25 relative to the housing 1 is not adaptable to the position of the skin relative to the housing 1. In the second, third and fourth embodiments of the depilation apparatus according to the invention, the vibratory motion of the vibration end piece 25 is not kinematically defined so that the position of the end piece 25 relative to the housing 1 is adaptable to the position of the skin relative to the housing 1 and contact between the end piece 25 and the skin is maintained. It is noted, therefore, that the means for vibrating the carrier may have a vibratory mechanism with a kinematically defined position or a vibratory mechanism with a kinematically indefinite position.

As discussed above, a parallelogram mechanism is used in the third embodiment of the depilation apparatus according to the invention for converting the pivoting motion of the lever 63 into a substantially rectilinear motion of the connecting rod 81 and the end piece 25. It is noted that such a parallelogram mechanism may also be used also in the fourth embodiment of the depilation apparatus. With such a parallelogram mechanism in the fourth embodiment of the depilation apparatus, the pivoting motion of the lever 95 is converted into a rectilinear motion of the carrier 19 which is coupled to the lever 95 so as to be pivotable about a further axis extending parallel to the first axis. With such a parallelogram mechanism, the mechanical stop 113 with the first and second arms 115 and 117 may be replaced by a single mechanical stop between the lever 95 and a guiding member corresponding to the guiding member 85 in the third embodiment of the depilation apparatus. Instead of said parallelogram mechanism in the third embodiment, furthermore, a construction may be used in which the carrier 19 is fixedly coupled to the lever 63, so that the motion of the carrier 19 is a pivoting vibratory motion.

It is further noted that instead of the helical spring 79 in the third embodiment of the depilation apparatus another kind of mechanical spring may be used such as, for example, a mechanical leaf spring. Such a mechanical leaf spring is mounted to the lever and freely bears on a mounting member fixedly attached to the eccentric member. With such a leaf spring, an alternating mechanical moment on the lever 63 is achieved in that the mounting member is alternately situated at one side and at the other, opposite side of the first axis 67 seen in an imaginary plane extending perpendicular to the first axis 67.

It is finally noted that, according to the invention, in the third embodiment of the depilation apparatus the adjustment member 65 may be omitted. In such an alternative embodiment, the first axis 67 of the lever 63 substantially coincides with the second axis 73 of the eccentric member 69. The adjustment member 65 may be guided relative to the housing 1 in the direction perpendicular to the first axis 67 by means of a rectilinear guide or, for example, by means of a circular guide. Alternatively, the adjustment member 65 may be fixedly coupled to a control knob which is rotatable relative to the housing 1 about an axis of rotation extending parallel to the first axis 67. In an alternative embodiment, instead of the lever 63, the eccentric member 69 may be mounted to the adjustment member 65 so as to be pivotable about the second axis of rotation 73. In this alternative embodiment, the second axis 73 is displaceable relative to the housing 1 whereas the first axis 67 is in a fixed position relative to the housing 1.

What is claimed is:

1. A depilator apparatus comprising a housing, a depilation member for gripping hairs on human skin and pulling the hairs from the skin and a vibration member for exerting mechanical vibration on the skin to thereby provide an anaesthetizing effect on the skin while the hairs are being pulled from the skin by the depilation member, both the depilation member and the vibration member provided in the housing, characterized in that the vibration member comprises flexible protrusions for contacting the skin which are disposed on a carrier and means for vibrating the carrier to thereby vibrate the flexible protrusions and thereby exert mechanical vibrations on the skin where these vibrating flexible protrusions contact the skin.

2. A depilation apparatus as claimed in claim 1, characterized in that the protrusions are disposed in a uniform pattern.

3. A depilation apparatus as claimed in claim 2 wherein the protrusions have a conical shape.

4. A depilation apparatus as claimed in claim 2 wherein the protrusions each have a rounded end portion.

5. A depilation apparatus as claimed in claim 2 wherein the protrusions comprise an elastomeric material.

6. A depilation apparatus as claimed in claim 1, characterized in that each of the protrusions having a conical shape.

7. A depilation apparatus as claimed in claim 6 wherein the protrusions each have a rounded end portion.

8. A depilation apparatus as claimed in claim 6 wherein the protrusions comprise an elastomeric material.

9. A depilation apparatus as claimed in claim 1, characterized in that the protrusions each have a rounded end portion.

10. A depilation apparatus as claimed in claim 9 wherein the protrusions comprise an elastomeric material.

11. A depilation apparatus as claimed in claim 1, characterized in that the protrusions comprise an elastomeric material.

12. A depilation apparatus as claimed in claim 1, characterized in that the means for vibrating the carrier comprise a lever which is pivotable about a first axis, an eccentric member which is rotatable by an electric motor about a second axis extending substantially parallel to the first axis and which comprises a mounting member disposed eccentrically relative to the second axis, and a mechanical spring prestressed between the lever and the mounting member.

13. A depilation apparatus as claimed in claim 12, characterized in that the mechanical spring is a helical spring extending substantially perpendicular to the first axis, the mounting member being mounted to the eccentric member so as to be pivotable about a third axis extending substantially parallel to the first axis.

14. A depilation apparatus as claimed in claim 13 wherein the lever is mounted to an adjustment member so as to be pivotable about the first axis, the adjustment member being displaceable relative to the housing in a direction perpendicular to the first axis.

15. A depilation apparatus as claimed in claim 12, characterized in that the lever is mounted to an adjustment member so as to be pivotable about the first axis, the adjustment member being displaceable relative to the housing in a direction perpendicular to the first axis.

16. A depilation apparatus as claimed in claim 12, characterized in that the means for vibrating the carrier comprise a mechanical stop for limiting a range of movement of the vibration member.

17. A depilation apparatus as claimed in claim 12, characterized in that the carrier is mounted to the lever so as to be pivotable about a fourth axis extending substantially parallel to the first axis, the means for vibrating the carrier further comprising a guiding member which is mounted to the carrier so as to be pivotable about a fifth axis extending substantially parallel to the first axis and is mounted to the housing so as to be pivotable about a sixth axis extending substantially parallel to the first axis.

18. A depilation apparatus as claimed in claim 1, characterized in that the means for vibrating the carrier comprise a lever which is pivotable about a first axis, a cam which is rotatable by an electric motor about a second axis substantially coinciding with the first axis, a cam follower which is displaceable relative to the lever in a direction perpendicular to the first axis, and a mechanical spring prestressed between the lever and the cam follower.

19. A depilation apparatus as claimed in claim 1, characterized in that the means for vibrating the carrier comprise an eccentric member which is rotatable by an electric motor about a first axis and comprises a mounting member disposed eccentrically relative to the first axis, the means for vibrating the carrier further comprising a coupling member which is mounted to the mounting member so as to be pivotable about a second axis extending substantially parallel to the first axis and is mounted to the carrier so as to be pivotable about a third axis extending substantially parallel to the first axis, the carrier being guided relative to the housing in a direction perpendicular to the first axis.

20. A depilation apparatus as claimed in claim 19, characterized in that the eccentric member is rotatably journalled relative to a lever about the first axis, the lever is pivotable about a fourth axis extending parallel to the first axis, and a mechanical spring is prestressed between the lever and the housing.

* * * * *